US008479956B2

(12) United States Patent
Lewis, II et al.

(10) Patent No.: US 8,479,956 B2
(45) Date of Patent: Jul. 9, 2013

(54) SOAP DISPENSER HAVING A KEYED BOTTLE SYSTEM

(75) Inventors: Ronald A. Lewis, II, Phoenix, AZ (US); Todd Gatzulis, Scottsdale, AZ (US)

(73) Assignee: The Dial Corporation, Scottsdale, AZ (US)

( * ) Notice: Subject to any disclaimer, the term of this patent is extended or adjusted under 35 U.S.C. 154(b) by 525 days.

(21) Appl. No.: 12/611,644

(22) Filed: Nov. 3, 2009

(65) Prior Publication Data

US 2011/0101029 A1 May 5, 2011

(51) Int. Cl.
*B67B 1/00* (2006.01)

(52) U.S. Cl.
USPC ..... 222/153.03; 222/181.3

(58) Field of Classification Search
USPC ..... 222/153.03, 180, 181.1–181.3, 325
See application file for complete search history.

(56) References Cited

U.S. PATENT DOCUMENTS

| | | | | |
|---|---|---|---|---|
| 4,345,627 | A | 8/1982 | Cassia | |
| 4,391,309 | A | 7/1983 | Steiner | |
| 4,429,812 | A | 2/1984 | Steiner et al. | |
| 4,741,461 | A | 5/1988 | Williamson et al. | |
| 5,035,389 | A | 7/1991 | Wang | |
| 5,175,791 | A | 12/1992 | Muderlak et al. | |
| 5,226,625 | A | 7/1993 | Hanna | |
| 5,261,557 | A | 11/1993 | Bytell et al. | |
| 5,421,489 | A | 6/1995 | Holzner, Sr. et al. | |
| 5,433,416 | A * | 7/1995 | Johnson | 248/475.1 |
| 5,613,625 | A * | 3/1997 | Specht | 222/180 |
| 5,682,930 | A | 11/1997 | Crossdale | |
| 5,791,525 | A * | 8/1998 | Fan | 222/181.3 |
| 5,992,698 | A * | 11/1999 | Copeland et al. | 222/180 |
| 6,098,941 | A | 8/2000 | Gates et al. | |
| 6,321,943 | B1 * | 11/2001 | Strickler et al. | 222/82 |
| 6,325,245 | B1 | 12/2001 | Matthews | |
| 6,543,651 | B2 | 4/2003 | Lewis et al. | |
| 6,808,090 | B2 * | 10/2004 | Pedersen | 222/181.3 |
| 6,877,642 | B1 | 4/2005 | Maddox et al. | |
| 7,290,683 | B2 * | 11/2007 | Gerenraich | 222/180 |
| 2008/0283556 | A1 | 11/2008 | Snodgrass | |
| 2009/0026225 | A1 | 1/2009 | Lickstein | |

FOREIGN PATENT DOCUMENTS

| | | | |
|---|---|---|---|
| EP | 0 042 310 | B1 | 6/1983 |
| GB | 2 375 754 | A | 11/2002 |
| WO | WO 95/12544 | A1 | 5/1995 |

* cited by examiner

*Primary Examiner* — Lien Ngo
(74) *Attorney, Agent, or Firm* — David K. Benson

(57) ABSTRACT

An apparatus for dispensing a personal care product includes a housing, a first panel disposed inside the housing and including a plurality of receptacles, and a first key that is sized to be interchangeably received in each of the receptacles. The apparatus further includes a container sized and shaped to be secured in a particular orientation within the housing, and having a surface that faces the panel when the container is secured in the particular orientation within the housing. A first depression is formed in the container surface to complement with specificity the first key's exterior shape and positioned to pair with the key when the container is secured in the particular orientation within the housing and the key is received in one of the receptacles.

17 Claims, 3 Drawing Sheets

SOAP DISPENSER HAVING A KEYED BOTTLE SYSTEM

TECHNICAL FIELD

The present invention generally relates to dispensers for personal care products. More particularly, the present invention relates to dispensers that are often used in commercial or industrial facilities that dispense personal care compositions in various forms such as liquids, creams, lotions, and foams and include keying systems that match a dispenser with a particular container that holds such compositions.

BACKGROUND

Restrooms in commercial or industrial settings commonly have dispensers for soaps, lotions, hair-care formulations, and a variety of other personal care products. Among other benefits, the dispensers provide a metered amount of product to a user in a completely or nearly hand-free fashion. Commonplace dispensers are wall-mounted devices that house a container for a personal care product. A pump that is in communication with the container dispenses the product from the container when actuated by a user. Some sophisticated dispensers are capable of housing two or more containers and include a plurality of associated pumps so a user can select and receive a specific desired personal care product depending on the pump that the user chooses to actuate.

After a container is emptied it is removed from the dispenser and a new refill container is replaced therein. One problem with many dispensers is that they are capable of housing many containers of similar shape and size. Consequently, a container for the wrong type of personal care product may be mistakenly placed into a dispenser during a refill procedure. If a dispenser is capable of housing two or more containers it can be particularly easy to inadvertently place a container of one personal care product into a dispenser that is intended for a different personal care product. Another problem with such generic dispensers is that if an incorrect or low quality personal care product is used as a refill, the pump may become clogged or otherwise fail to dispense the product in an optimal manner.

Another problem with many dispensers is that they can become outdated if they are too specifically adapted for particular containers of personal care products. For example, a perfectly functional container may be useless for a new or reformulated personal care product if that product is packed in a different container than the one for which the dispenser is intended.

Accordingly, it is desirable to provide a dispenser that is adapted to only receive particular personal care product containers. In addition, it is desirable to provide a dispenser that can be modified to receive different personal care product containers as desired. Furthermore, other desirable features and characteristics of the present invention will become apparent from the subsequent detailed description and the appended claims, taken in conjunction with the accompanying drawings and the foregoing technical field and background.

BRIEF SUMMARY

According to one embodiment, an apparatus is provided for dispensing, a personal care product. The apparatus includes a housing, a first panel disposed inside the housing and including a plurality of receptacles, and a first key that is sized to be interchangeably received in each of the receptacles. The apparatus further includes a container sized and shaped to be secured in a particular orientation within the housing, and having a surface that faces the panel when the container is secured in the particular orientation within the housing. A first depression is formed in the container surface to complement with specificity the first key's exterior shape and positioned to pair with the key when the container is secured in the particular orientation within the housing and the key is received in one of the receptacles.

According to another embodiment, an apparatus is provided for dispensing a product from a container having a first depression formed therein that is indicative of the product inside the container. The apparatus includes a housing, a first panel disposed inside the housing and comprising a plurality of receptacles, and a first key that is sized to be interchangeably received in each of the receptacles, and shaped to complement with specificity the first depression's shape, the first key being positionable in one of the receptacles to pair with the first depression when the container is secured in a particular predetermined orientation within the housing.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
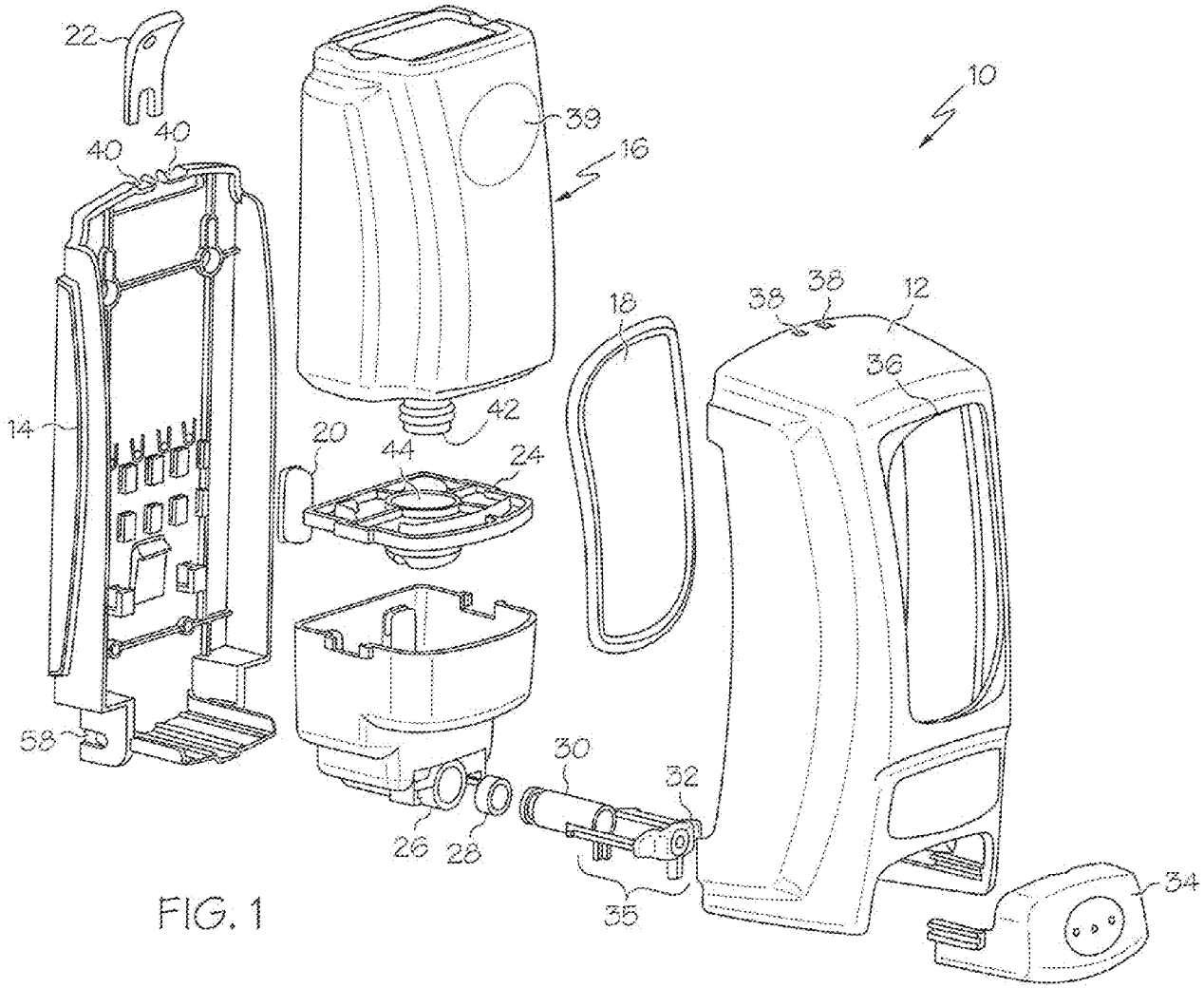
FIG. 1 is an exploded view of a dispenser for a personal care product according to an embodiment of the present invention.

Turning now to FIG. 1, an exploded view of an exemplary dispenser 10 for a personal care product is depicted. As will be explained in detail the dispenser's outer shape and style, its mechanical configuration, and its general assembly are not necessarily represented by the depicted dispenser 10. Rather, the depicted dispenser 10 is just one of a vast number of variations that can incorporate the present inventive features. The dispenser includes a housing that is adapted to contain and secure a personal care product container 16 therein. According to the depicted embodiment the dispenser housing includes a front panel 12 and a rear panel 14 that together define an interior space that is large enough to enclose the container 16. The front panel 12 includes a window 36 to allow for indicia 39 on the container 16 to be viewed. A panel 18 fits inside the window 36 to protect the container 16. According to a preferred embodiment the panel 18 is formed from a rigid material, such as a transparent polymer, that is sufficiently durable to prevent tampering with the dispenser 10. The panel 18 is highly transparent, although it may be either clear or colored. Regardless of whether the panel 18 is colorful or substantially colorless, the panel 18 is sufficiently transparent to allow the indicia 39 on the container 16 to be easily viewed through the window 36.

The front panel 12 and rear panel 14 may be assembled by sliding a pair of opposed hinge pegs located on the front panel lower inner walls into corresponding hinge guides 58 disposed on the rear panel 14. With the hinge pegs secured in place, the panels 12, 14 are then rotated about the hinges so their tops are brought together. The panels 12, 14 are locked in place as a pair of fingers 40 on the rear panel snap into receiving holes 38 on the front panel.

A reservoir 26 is also part of the dispenser 10 to facilitate passage of the personal care product from the container 16 to an end user. The container 16 is further supported by a reservoir cover 24. The container 16 has a mouth 24 through which the personal care product flows when it is dispensed. An opening 44 in the reservoir cover 24 is sized to allow the mouth 42 to pass through it and past the reservoir cover 24. The personal care product flows out of the container 16 through the reservoir 26 and then through a check valve and a valve retainer 28. A pump 30 and a pump tip 32 together form an exit channel 35 through which the personal care product is dispensed to an end user when an actuating button 34 is depressed.

A panel is disposed in the housing and positioned to oppose a side of the container 16. An exemplary housing employs the rear panel 14 in this manner, although any appropriately situated panel will suffice. As will be described in greater detail in the following description, the panel 14 includes a plurality of receptacles, each of which is adapted to receive a key member 20.

Figure 2:
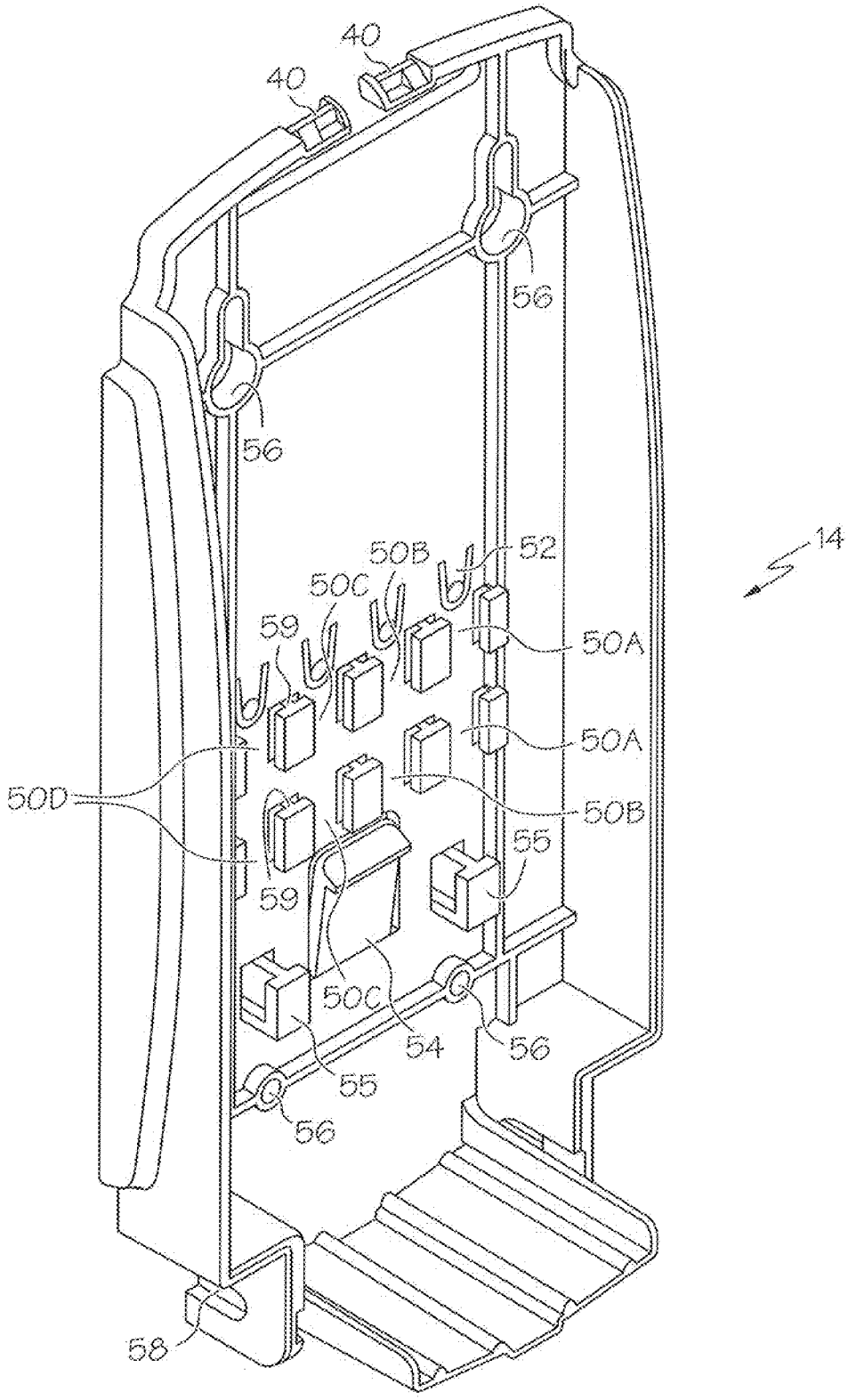
FIG. 2 is a perspective view of a panel of the dispenser depicted in FIG. 1, the panel including a plurality of receptacles for a key member according to an embodiment of the present invention.

Turning now to FIG. 2, the rear panel 14 is depicted in detail. As previously mentioned, the rear panel 14 may be mounted and assembled with other dispenser components in numerous ways. As one non-limiting example, the rear panel includes a plurality of mounting holes 56 that engage with screws or mounting posts and thereby secure the rear panel 14 in place. Also, a pair of posts is used to mount the reservoir 26 inside the dispenser 10, and a clip 54 is used to securely hold the reservoir cover 24 in place.

Figure 3:
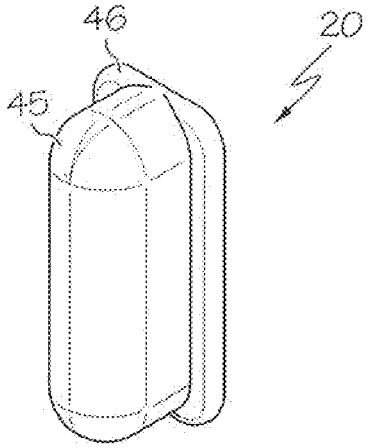
FIG. 3 is a perspective view of a key member that is sized to be interchangeably received in any one of the receptacles in the panel depicted in FIG. 2 according to an embodiment of the invention.

The panel 14 includes two or more receptacles, and in the depicted embodiment the panel 14 includes four receptacles 50A, 50B, 50C, and 50D. Each receptacle is adapted to receive a key member 20. FIG. 3 is a perspective view of an exemplary key member 20 that is adapted to fit in any one of the receptacles 50A, 50B, 50C, and 50D in the panel 14 depicted in FIG. 2. The key member 20 includes two functional components, namely, a key 45 and an attachment component 46. The key 45 is shaped to complement and pair with a recession in the container 16 as will be described in further detail. The attachment component 46 is structurally adapted to be interchangeably secured in any one of the receptacles 50A, 50B, 50C, and 50D and to consequently lock the key 45 in a fixed predetermined position. According to the exemplary embodiment that is depicted in the figures, the attachment component 46 is one or more tabs that secure the key member 20 in place on the back plate 14 by engaging with slots 59 formed in the back plate 14. Opposed slots 59 define a receptacle in which the tabs are slidingly received and secured in place.

In addition, tabs 52 or other suitable locking members for locking the key member 20 in place are situated adjacent to the receptacles 50A, 50B, 50C, and 50D. The tabs 52 are made of a flexible material, and are preferably formed from the same material as the panel 14 for ease in manufacturing. According to an exemplary embodiment a tab 52 is disposed adjacent to an entrance point at which the key member 20 is inserted into a receptacle so when a key member 20 is inserted into a receptacle the tab is elastically displaced by the key member 20 as it slides over the tab 52. Once the key member 20 slides over and off the tab 52 and is fully engaged in the receptacle by the slots 59, the tab 52 snaps to its predisposed orientation and thereby locks the key member 20 in place. In order to remove the key member 20 an end user must depress the tab 52 and thereby clear the pathway from the receptacle and allow the key member 20 to slide out.

Figure 4:
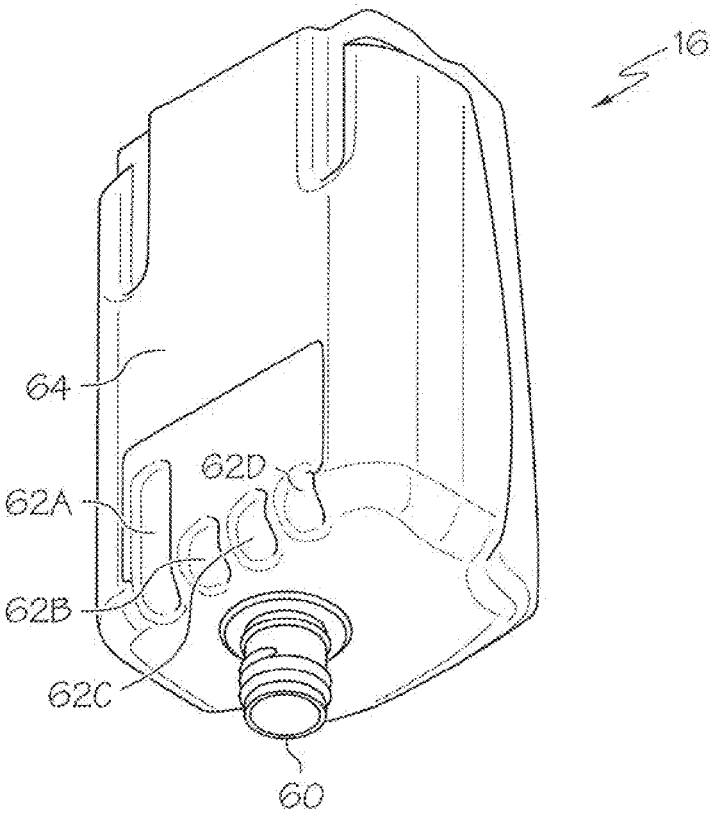
FIG. 4 is a perspective view of a container for a personal care product that is sized to be housed in the dispenser depicted in FIG. 1 according to an embodiment of the present invention.

Turning now to FIG. 4, the personal care product container 16 is depicted. The container 16 is sized and shaped to be secured in a particular orientation within the housing so that a surface 64 faces the panel when the container is in place. At least one depression 62A is formed in the container surface 64. The depression 62A is shaped to complement with specificity the shape of the key 45 and is positioned to pair with the key 45 when the container 16 is secured in its particular orientation within the housing and the key member 20 is secured in the corresponding receptacle 50A. Accordingly, the key 45 will prevent any container other than one having an appropriately positioned and shaped depression 62A from being inserted into the container 16.

As previously discussed, one problem with conventional dispensers is that they are capable of housing many containers of similar shape and size. Consequently, a container for an unintended personal care product, or a product of undesirable quality, may be placed into a dispenser during a refill procedure. In contrast, the dispenser 10 that incorporates the key member 20 in a specified receptacle 50A can only receive the container 16 having the complementary depression 62A. Any container that does not have an appropriately sized and situated depression will be impeded by the key member 20 from fitting inside the dispenser 10 in a functional manner.

FIG. 4 also depicts additional recesses 62B, 62C, and 62D that individually represent potential spaces along the container surface 64 for additional depressions that can be sized and shaped like the key-specific depression 62. The additional recesses 62B, 62C, and 62D are not shaped to match with the key 45 but are holding places for recesses that would match with the key 45. Returning now to FIG. 2, the receptacles 50B, 50C, and 50D are identical to receptacle 50A and also have tabs like tab 52 that will lock a key member 20 in place when situated in one of the receptacles 50B, 50C, and 50D. Receptacle 50B is situated to hold in place a key member 20 that, when so situated, will match with a depression that is sized and shaped like depression 62A but is located about the area where recess 62B is formed in the container 16. Likewise, the receptacles 50C and 50D are situated to hold in place a key member 20 that, when so situated, will match with depressions that are sized and shaped like depression 62A but are respectively located about the areas where recesses 62C and 62D are formed in the container 16.

The construction of identical receptacles 50A-D in the panel 14 situated to correspond with directly opposing depressions formed in the container 16 enables the key member 20 to be interchangeably received in any of the receptacles 50A-D depending on the type of container 16 that is to be received in the dispenser 10. For example, containers for different personal care products, i.e. soap, lotion, shampoo, hair conditioner, or body wash, will each have different recess patterns on the surface 64 that faces the panel receptacles 50A-D. Consequently, one or more key members 20 may be interchangeably placed in appropriate receptacles 62A-D in order to accommodate any kind of container 16 having an appropriate recess pattern. I If for any reason it is desirable to change out one personal care product from the dispenser 10 and replace it with a different one, then it will be necessary to change the key pattern in the panel receptacles 50A-D in the dispenser 10. As containers for different personal care products have different recess patterns, corresponding key patterns can be modified to accommodate different containers by simply removing one or more key members 20 from some panel receptacles 50A-D and repositioning one or more keys into other panel receptacles 50A-D.

According to an exemplary embodiment, each of the key members 20 is substantially identically sized and shaped. Consequently, each of the panel receptacles 50A-D is also substantially identical in order to accommodate each substantially identical key member 20. Since each key member 20 is substantially identical, the key members 20 can be easily and interchangeably rearranged among each of the receptacles 50A-D. Furthermore, a dispenser 10 can easily have its key pattern modified in order for the dispenser to readily function as a dispenser for any appropriate personal care product. At the same time, the particular key pattern in a dispenser prevents accidental use of a personal care product that the dispenser is not intended to dispense.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A dispensing apparatus, comprising:

a housing;

a first panel disposed inside the housing and comprising a plurality of receptacles;

a first key that is sized to be interchangeably received in each of the receptacles;

at least one optional additional key that is also sized to be interchangeably received in each of the receptacles;

a container sized and shaped to be secured in a particular orientation within the housing, and having a surface that faces the panel when the container is secured in the particular orientation within the housing; and a first depression formed in the container surface to complement with specificity a single key's exterior shape and positioned to pair with that single key when the container is secured in the particular orientation within the housing and that single key is received in one of the receptacles;

whereby some or all receptacles may be selected to either hold a key or not hold a key, and the absence or presence of keys in the receptacles creates a pattern that enables the first panel to complement and receive the container surface.

2. The dispensing apparatus according to claim 1, wherein each of the plurality of receptacles is substantially identical in shape and size.

3. The dispensing, apparatus according to claim 2, further comprising a plurality of additional keys that substantially share the same exterior shape as the first key and are substantially identically sized to be interchangeably received in each of the receptacles.

4. The dispensing apparatus according to claim 3, further comprising a plurality of additional depressions formed in the container surface to respectively complement with specificity the additional keys'exterior shapes and positioned to pair with respective keys when the container is secured in the particular orientation within the housing and the keys are received in each of the receptacles.

5. The dispensing apparatus according to claim 1, further comprising a locking member adapted to lock the key into one of the receptacles, the locking member being disposed adjacent to an entrance point where the key is inserted into one of the receptacles.

6. The dispensing apparatus according to claim 5, wherein the locking member is a tab that has a predisposed position and orientation so that the tab is elastically displaced by the key as the key slides over the entrance point when the key is inserted into one of the receptacles, and then returns to its predisposed orientation to lock the key in place once the key slides off the tab and is fully engaged in one of the receptacles.

7. The dispensing apparatus according to claim 1, further comprising:

a second panel that is attached to the first panel and which, together with the first panel, encloses the container inside the dispenser;

a window formed in the second panel; and indicia displayed on the container that is viewable through the window.

8. The dispensing apparatus according to claim 7, further comprising a and that is secured inside the window and that is sufficiently transparent to view the indicia displayed on the container through the panel.

9. The dispensing apparatus according to claim 8, wherein the panel is formed from a rigid material.

10. An apparatus for dispensing a product from a container having a first depression formed therein that is indicative of the product inside the container, the apparatus comprising:

a housing;

a first panel disposed inside the housing and comprising a plurality of receptacles;

a first key that is sized to be interchangeably received in each of the receptacles, and shaped to complement with specificity the first depression's shape, the first key being positionable in any one of the receptacles to pair with the first depression when the container is secured in a particular predetermined orientation within the housing;

at least one optional additional key that is also sized to he interchangeably received in each of the receptacles, is shaped to complement with specificity any additional depression shape formed in the container, and is positionable in any one of the receptacles to pair with a depression when the container is secured in the particular predetermined orientation within the housing, whereby some or all receptacles may be selected to either hold a key or not hold a key, and the absence or presence of keys in the receptacles creates a pattern that enables the first panel to complement an receive the container.

11. The apparatus according to claim 10, wherein each of the plurality of receptacles is substantially identical in shape and size.

12. The apparatus according to claim 11, further comprising a plurality of additional keys that substantially share the same exterior shape as the first key and are substantially identically sized to be interchangeably received in each of the receptacles.

13. The apparatus according to claim 10, further comprising a locking member adapted to lock the key into one of the receptacles, the locking member being disposed adjacent to an entrance point where the key is inserted into one of the receptacles.

14. The apparatus according to claim 13, wherein the locking member is a tab that has a predisposed position and orientation so that the tab is elastically displaced by the key as the key slides over the entrance point when the key is inserted into one of the receptacles, and then returns to its predisposed orientation to lock the key in place once the key slides off the tab and is fully engaged in one of the receptacles.

15. The apparatus according to claim 10, further comprising:

a second panel that is attached to the first panel and which, together with the first panel, encloses the container inside the dispenser;

a window formed in the second panel; and indicia displayed on the container that is viewable through the window.

16. The dispensing apparatus according to claim 15, further comprising a panel that is secured inside the window and that is sufficiently transparent to view the indicia displayed on the container through the panel.

17. The dispensing apparatus according to claim 16, wherein the panel is formed from a rigid material.

* * * * *